US006942450B2

(12) United States Patent
Yang et al.

(10) Patent No.: US 6,942,450 B2
(45) Date of Patent: Sep. 13, 2005

(54) DIFFERENTIAL PRESSURE SENSING SYSTEM FOR AIRFOILS USABLE IN TURBINE ENGINES

(75) Inventors: Wen-Ching Yang, Export, PA (US); Maria E. Stampahar, Trafford, PA (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 115 days.

(21) Appl. No.: 10/646,875

(22) Filed: Aug. 22, 2003

(65) Prior Publication Data

US 2005/0042075 A1 Feb. 24, 2005

(51) Int. Cl.[7] ..... F01D 5/00

(52) U.S. Cl. ..... 415/115; 415/118; 416/97 R; 416/61

(58) Field of Search ..... 415/115, 118; 416/96 R, 416/96 A, 97 R, 61

(56) References Cited

U.S. PATENT DOCUMENTS 4,057,371 A 11/1977 Pilarczyk
4,058,975 A 11/1977 Gilbert et al.
4,153,386 A * 5/1979 Leogrande et al. ..... 415/115
4,744,670 A 5/1988 Janssen
4,901,520 A 2/1990 Kozak et al.
5,014,544 A 5/1991 West
5,193,975 A * 3/1993 Bird et al. ..... 415/115
5,305,599 A 4/1994 Marvin
5,417,057 A 5/1995 Robey
5,511,937 A 4/1996 Papageorgiou
5,819,540 A 10/1998 Massarani
6,361,276 B1 3/2002 Beachum et al.
6,520,020 B1 2/2003 Lutz et al.

* cited by examiner

*Primary Examiner*—Edward K. Look
*Assistant Examiner*—Igor Kershteyn

(57) ABSTRACT

A detection system for identifying airfoils having a cooling systems with orifices that are plugged with contaminants or with showerheads having a portion burned off. The detection system measures pressures at different locations and calculates or measures a differential pressure. The differential pressure may be compared with a known benchmark value to determine whether the differential pressure has changed. Changes in the differential pressure may indicate that one or more of the orifices in a cooling system of an airfoil are plugged or that portions of, or all of, a showerhead has burned off.

20 Claims, 5 Drawing Sheets

DIFFERENTIAL PRESSURE SENSING SYSTEM FOR AIRFOILS USABLE IN TURBINE ENGINES

STATEMENT OF GOVERNMENT INTEREST

Development for this invention was supported in part by U.S. Department of Energy Contract No. DE-FC26-01 NT41232. Accordingly, the United States Government may have certain rights in this invention.

FIELD OF THE INVENTION

This invention is directed generally to cooling systems for airfoils in turbine engines, and more particularly to systems for identifying blockages in airfoil cooling systems.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose airfoils, such as turbine blade and vane assemblies, to these high temperatures. As a result, the airfoils must be made of materials capable of withstanding such high temperatures. In addition, the airfoils often contain cooling systems for prolonging the life of the airfoils and reducing the likelihood of failure as a result of excessive temperatures.

Typically, airfoils are formed from an elongated portion, a leading edge, and a trailing edge. The inner aspects of most airfoils typically contain an intricate maze of cooling channels forming a cooling system. The cooling channels in the airfoils receive air from compressors of turbine engines and pass the air through the airfoils. The cooling channels often include multiple flow paths designed to maintain all aspects of the airfoils below design temperature. However, centrifugal forces and air flow at boundary layers often prevent some areas of the airfoils from being adequately cooled, which results in the formation of localized hot spots. In addition, contaminants in the cooling fluid flowing through the airfoils can clog impingement orifices and film cooling orifices in the airfoils, which can also produce localized hot spots. Localized hot spots, depending on their location, can reduce the useful life of a turbine blade and can damage a turbine blade to an extent necessitating replacement of the blade.

Operating turbine engines having airfoils with plugged impingement cooling orifices or film cooling orifices can result in catastrophic damage to the airfoil or the turbine engine, or both. For instance, airfoils having plugged impingement cooling orifices or film cooling orifices operate at elevated temperatures, which if elevated to too high a temperature can cause failure of the airfoils. During failure of an airfoil, portions of the airfoil break off and strike downstream components of a turbine engine, thereby damaging the airfoil. Thus, a need exists for a system for identifying airfoils in turbine engines having plugged cooling orifices before failure of these airfoils.

SUMMARY OF THE INVENTION

This invention relates to a detection system for use in airfoils having internal cooling systems, such as, but not limited to, turbine vanes and blades. The detection system may include a plurality of sensors for determining pressures at different locations throughout the airfoil. These pressure measurements may be used to determine differential pressures between locations. The differential pressures may, in turn, be compared with known benchmark differential pressures to determine whether the airfoil contains plugged impingement orifices, plugged film cooling orifices, or has suffered a loss of a portion of, or all of, a showerhead of the airfoil. The known benchmark differential pressure may be determined using sensors to sense the pressure of cooling fluids, which may originate from a compressor of a turbine engine, at various locations throughout the airfoil while cooling fluids pass through an airfoil containing no obstructions in the cooling orifices. Alternatively, the differential pressures may be determined by measuring the differential pressure when the new vanes or blades are first installed.

In at least one embodiment, the detection system may be used in a turbine vane. For instance, the turbine vane may be formed from a generally elongated hollow vane formed from an outer wall. The turbine vane may include a leading edge, a trailing edge, a first end configured to be coupled to a shroud of a turbine engine, a second end opposite the first end for sealing the turbine vane to a rotatable disc, and one or more cavities forming a cooling system in the hollow vane. The turbine vane may also include one or more impingements inserts in the at least one cavity forming an inner cooling cavity and an outer cooling cavity, whereby the at least one impingement insert includes at least one impingement orifice providing a gas pathway between the inner cooling cavity and the outer cooling cavity. One or more pressure sensors may be included in the detection system for measuring pressure in the inner cooling cavity, and one or more pressure sensors may be included in the detection system for measuring pressure in the outer cooling cavity between the impingement insert and the outer wall of the turbine vane.

The detection system may be configured to be placed in a variety of airfoils having internal cooling systems. In addition, the detection system is not limited to being used only in turbine vanes. However, the detection system is described herein as being installed in a turbine vane for example and not as a limitation. In at least one embodiment, the turbine vane may include a forward cavity, an aft cavity, and a mid cavity. These cavities may include impingement inserts mounted in one or more of the cavities. The detection system may be used to determine whether impingement orifices in the impingement inserts are plugged, whether film cooling orifices in the outer wall forming the vane are plugged, or whether a portion of, or all of, the showerhead has burned off. In addition, the detection system may be used to determine the answers to any combination of these queries. The detection system may also be used to determine one or more of these queries in one or more of the forward, aft and mid cavities of the turbine vane.

For example, the detection system may be used to determine a first pressure in an inner cavity of the turbine vane and a second pressure in an outer cavity between an impingement plate and the outer wall of the turbine vane. A differential pressure may be calculated or measured from the first and second pressures. The differential pressure may then be compared to a known benchmark differential pressure. An increase in differential pressure may indicate that impingement orifices in the impingement insert are plugged. On the other hand, a decrease in differential pressure may indicate that at least some of the film cooling holes are plugged. The orifices may be cleaned to open the plugged orifices and resume safe operation.

The detection system may also be used to determine whether the showerhead of the airfoil has been burned off. For example, the detection system may be used to measure a first pressure in an inner cavity of a turbine vane proximate to a showerhead of the turbine vane and to measure a second pressure at a combustor shell. The differential pressure may be measured and compared against a known benchmark value. Decreases in differential pressure may indicate that portions of or all of the showerhead has burned off.

An advantage of this detection system is that the detection system may be used to indicate when a specific vane is in need of servicing. In addition, the detection system of this invention requires little expense to be installed in airfoils of conventional turbine engines in use today. Furthermore, the detection system reduces the likelihood of catastrophic failure caused by an airfoil disintegrating because of thermal stresses. These and other advantages will become apparent upon review of these and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 2:
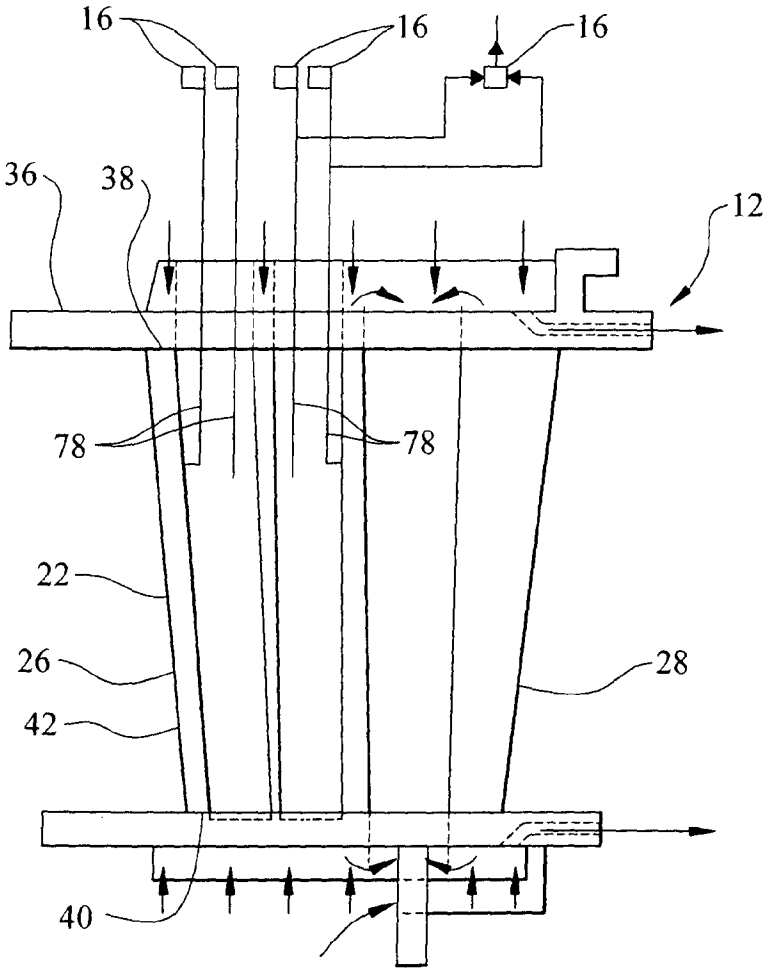
FIG. 2 is cross-sectional side view, referred to as a filleted view, of the turbine vane shown in FIG. 1.

As shown in FIGS. 1–8, this invention is directed to a detection system 10 for use in airfoils 12 having internal cooling systems 14, such as, but not limited to, turbine vanes and blades. The detection system 10 may be formed from a plurality of sensors 16 for determining pressures at different locations throughout the airfoil 12. These pressure measurements may be used to determine differential pressures. The differential pressures may be compared with known benchmark differential pressures to determine whether the airfoil 12 contains plugged impingement orifices 18, whether the airfoil 12 contains plugged film cooling orifices 76, 80, 82, and 84, or has suffered a loss of a portion of a showerhead 20 of the airfoil 12. The known benchmark differential pressure may be determined using the sensors 16 to sense the pressure of fluids at various locations throughout the airfoil 12 while cooling fluids pass through the airfoil 12 containing no obstructions. Alternatively, the benchmark differential pressures may be determined when the new vanes and blades are first installed, and thus free of contaminants. The sensors 16 may also be differential pressure transmitters for measuring differential pressures between at least two different locations.

Figure 1:
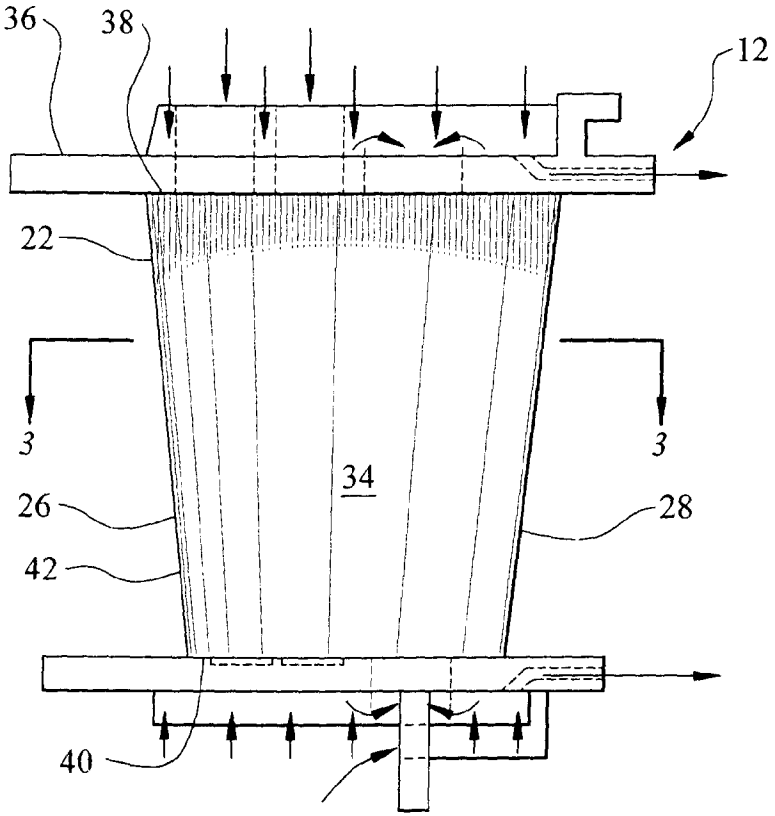
FIG. 1 is a side view of a turbine vane having features according to the instant invention.
Figure 3:
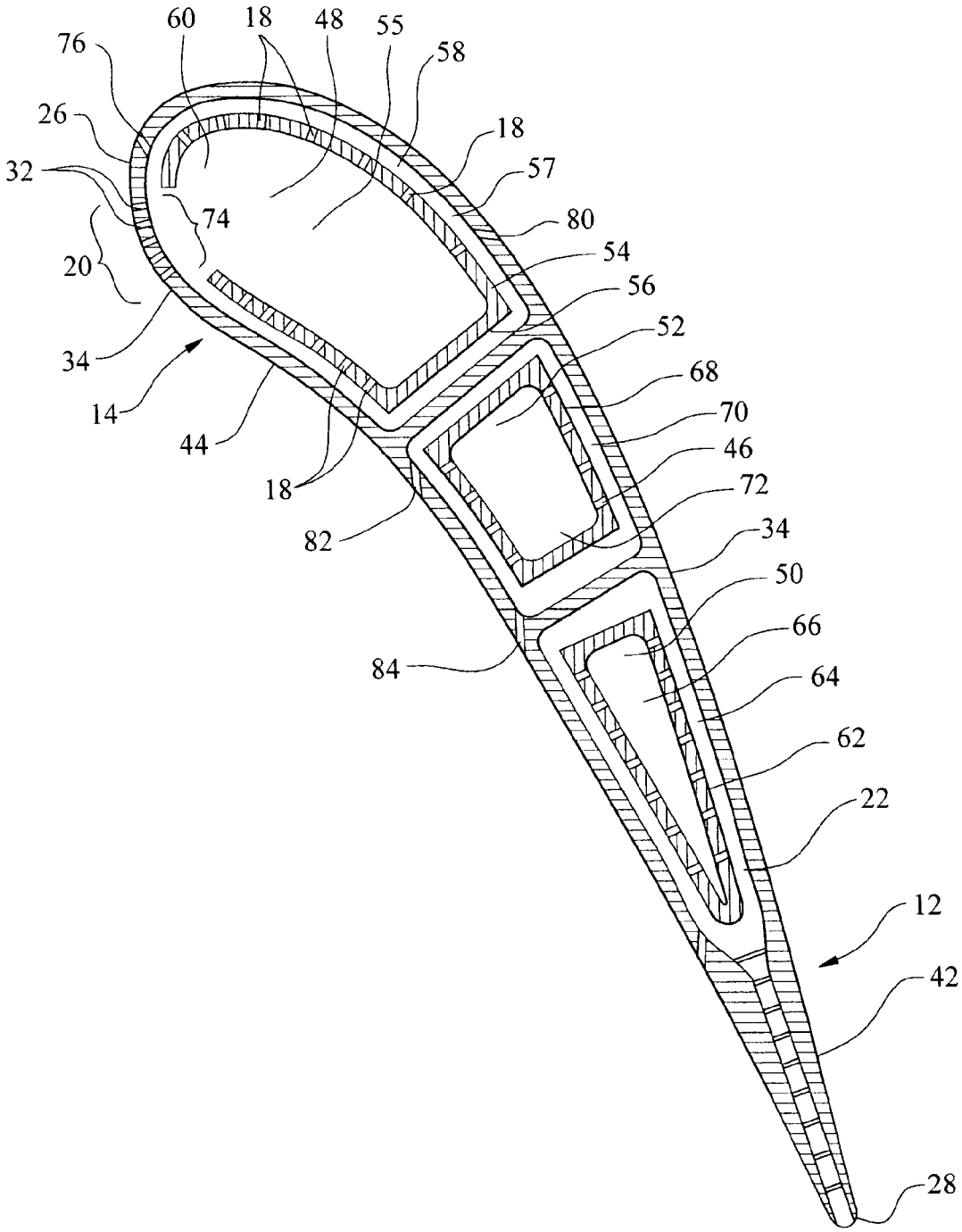
FIG. 3 is a cross-sectional top view of the turbine vane shown in FIG. 1 taken along line 3—3.

In at least one embodiment, the detection system 10 may be adapted to be used in a turbine vane 22, as shown in FIGS. 1–3. The detection system 10 is not limited to use with a turbine vane 22 having the configuration shown in FIG. 2 and described herein. Rather, the detection system 10 may be used in airfoils 12, such as turbine blade and other airfoils, having other configurations. However, for discussion purposes, the configuration of the detection system 10 in the turbine vane 22 shown in FIG. 2 is described herein. The turbine vane 22 may be formed from a generally elongated vane 24 having a leading edge 26 and a trailing edge 28. The leading edge 26 may include a showerhead 20 having a plurality of orifices 32 allowing cooling fluids to pass from inner aspects of the cooling system 14 to an outer surface 34 of the turbine vane to provide film cooling. The vane 24 may be adapted to be fixedly coupled to a turbine shroud 36 at a first end 38 and positioned proximate to a rotatable disc (not shown) at a second end 40. The turbine vane 22 may have an outer wall 42 adapted for use, for example, in a first stage of an axial flow turbine engine. Outer wall 42 may have a generally concave shaped portion forming pressure side 44 and may have a generally convex shaped portion forming suction side 46.

The cooling system 14 may include a forward cooling cavity 48, an aft cooling cavity 50, and a mid cooling cavity 52. As shown in FIG. 3, the turbine vane 22 may include one or more impingement inserts 54. For instance, the turbine vane 22 may include a forward impingement insert 56 positioned in the forward cooling cavity 48 forming an outer forward cooling cavity 58 and an inner forward cooling cavity 60. The turbine vane 22 may also include an aft impingement insert 62 positioned in the aft cooling cavity 50 forming an outer aft cooling cavity 64 and an inner aft cooling cavity 66. Still yet, the turbine vane may include a mid impingement insert 68 positioned in the mid cooling cavity 50 forming an outer mid cooling cavity 70 and an inner mid cooling cavity 72. The impingement inserts 54 may include a plurality of impingement orifices 18 for allowing cooling fluids to flow through the impingement inserts 54 to remove heat from the turbine vane 22. The forward impingement insert 56 may include an opening 74 allowing cooling fluids to pass through the orifices 32 forming the showerhead 20.

In another embodiments, the turbine vane 22 need not have a plurality of cavities forming the cooling system 14. Instead, the turbine vane 22 may include an impingement insert 54 forming an inner cooling cavity 55 and an outer cooling cavity 57 from the cooling system 14.

The detection system 10 may be configured to be positioned in an airfoil 12, such as a turbine vane 22. The detection system 10 may be configured to sense a pressure in a first location, for instance, in an inner cooling cavity 55 and sense a pressure in a second location, for instance, in an outer cooling cavity 57. The pressures identified using the detection system 10 may be used to calculate a differential pressure between the two locations. The differential pressure may be calculated by a microprocessor, personal computer, or other electronic device, measured by a differential pressure transmitter, or may be calculated by a user or in another manner.

As shown in FIG. 2, the detection system 10 may be formed from tubing 78 used to transfer the pressurized fluid to a sensor 16 to determine the pressure. In at least one embodiment, the detection system 10 may include tubing 78 positioned in one or more of the inner cavities 55, 60, 66, or 72, or any combination thereof, to measure the pressure of a cooling fluid. The tubing 78 positioned in the inner cavities 60, 66, or 72, may be made of material such as, but not limited to, stainless steel or other such materials. In at least one embodiment, the tubing 78 may be capable of withstanding operating temperatures of about 430 degrees Celsius. Tubing 78 may also be positioned in one or more of the outer cavities 57, 58, 64, or 70, or any combination thereof. The tubing 78 in the outer cavities 57, 58, 64, or 70 may be coupled to the impingement inserts 54 using, for instance, and not by way of limitation, welds, or other connectors. The tubing 78 may exit the combustion cavities through the inner shroud or the outer shroud (not shown) of the turbine engine. In other embodiments, the tubing 78 used to measure the pressure in the inner cavities 55, 60, 66, or 72 may measure the pressure in the combustor shell rather than the pressure in the inner cavities 55, 60, 66, or 72 because the pressures in the inner cavities 55, 60, 66, or 72 and the combustor shell are typically very close.

The detection system 10 may be capable of determining the existence of plugged impingement orifices 18 in the impingement inserts 54, 56, 62, or 68, or any combination thereof. Alternatively, or in addition, the detection system 10 may determine the existence of plugged in film cooling orifices 76, 80, 82, and 84 in the outer wall 42 forming the vane 24. Alternatively, or in addition, the detection system 10 may determine whether a portion of the showerhead 20 has burned off. For instance, the detection system 10 may measure a first pressure in an inner cooling cavity 55 of the airfoil 12 and measure a second pressure in an outer cooling cavity 57 of the airfoil 12. A differential pressure may be determined between the inner cooling cavity 55 and the outer cooling cavity 57 by comparing the first pressure measurement taken in the inner cooling cavity 55 with the second pressure taken in the outer cooling cavity 57. The differential pressure may be compared with a known benchmark differential pressure to determine whether impingement orifices 18 in the impingement insert 54 or film cooling orifices 76, 80, 82, and 84 in the outer wall 42 are plugged or whether the showerhead 20 has suffered a loss of material.

Figure 4:
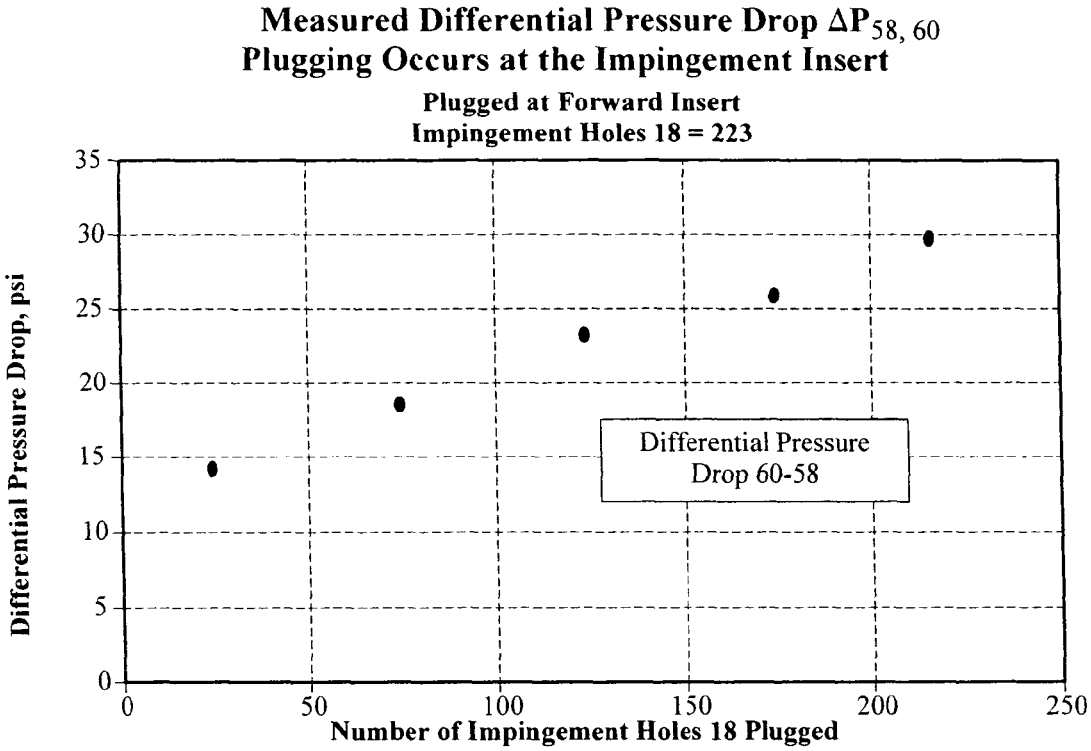
FIG. 4 is a chart depicting differential pressure drop verse number of holes plugged at the impingement insert in a forward chamber of the turbine vane.

In the turbine vane shown in FIGS. 1–3, plugging of the impingement orifices 18 may be identified when the differential pressure measured between a first pressure in the inner forward cooling cavity 60 and a second pressure in the outer forward cooling cavity 58 increases, as shown in FIG. 4. The detection system 10 is capable of measuring an increase of more than one pound per square inch (psi) with less than one percent of the impingement orifices 18 and 19 plugged. This process may be repeated in a similar fashion for the aft impingement insert 62 and the mid impingement insert 68 to determine whether impingement orifices 18 in the mid cooling cavity 52 and the aft cooling cavity 50 are plugged.

Figure 5:
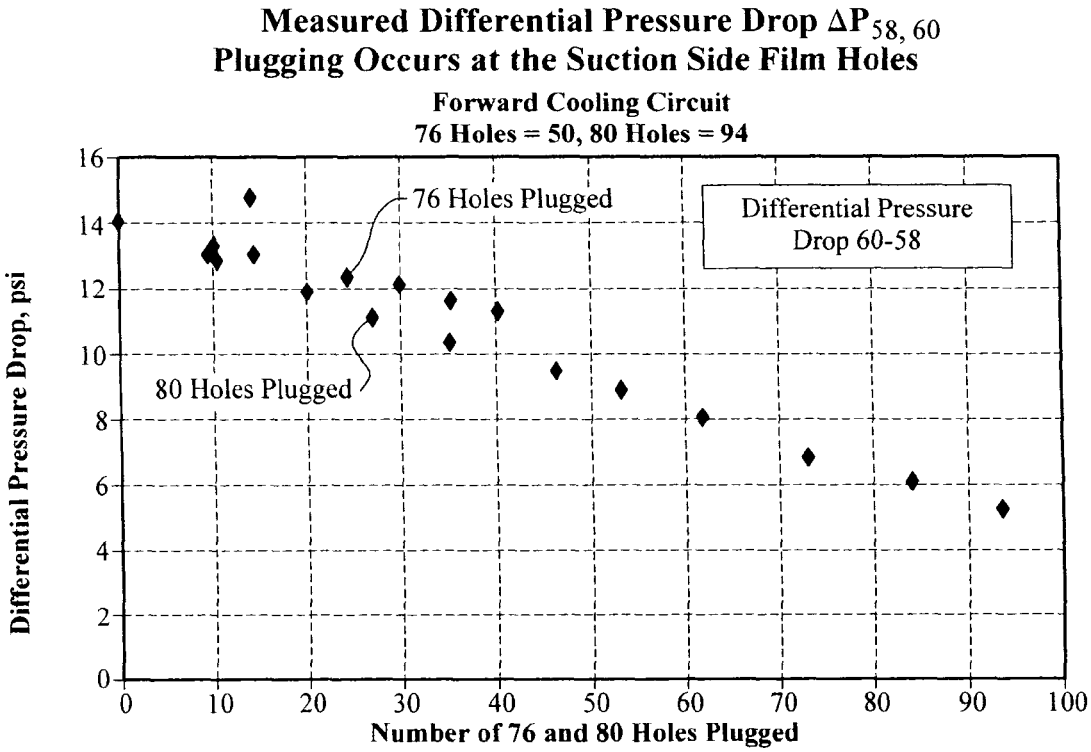
FIG. 5 is a chart depicting differential pressure drop verse number of film cooling holes plugged at the suction side film holes in a forward chamber.
Figure 8:
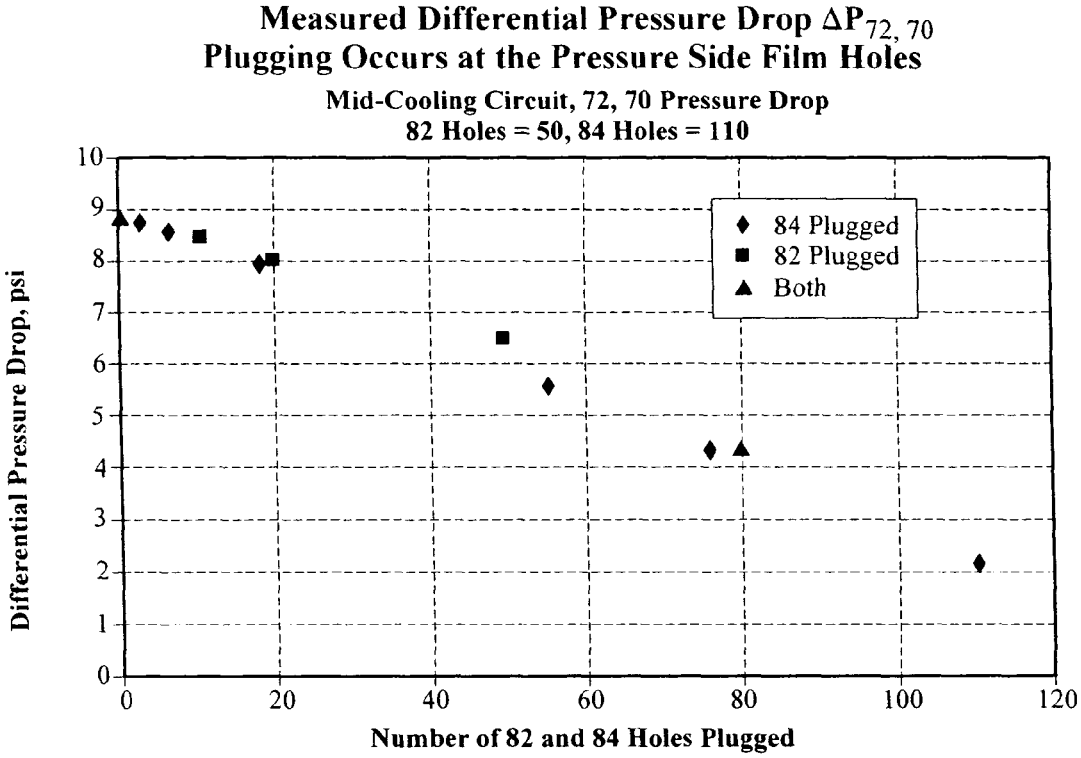
FIG. 8 is a chart depicting differential pressure drop verse number of plugged film cooling holes at the pressure side.

The detection system 10 may also be used to determine when film cooling orifices 76, 80, 82, and 84 are plugged. For instance, the detection system 10 may identify when film cooling orifices 76 and 80 are plugged by identifying decreases in differential pressure measured between a first pressure in the inner forward cooling cavity 60 and a second pressure in the outer forward cooling cavity 58, as shown in FIGS. 5 and 8. A differential pressure drop of about 1 psi equals about 10 film cooling orifices 76 and 80 plugged per 144 film cooling orifices. This process may be repeated in a similar fashion for the mid impingement insert 68 to determine whether film cooling orifices 82 and 84 in the mid cooling cavity 52 are plugged. Further, the process may be repeated for the aft impingement insert 62 to determine whether film cooling orifices in the aft cooling cavity 50 are plugged.

Figure 6:
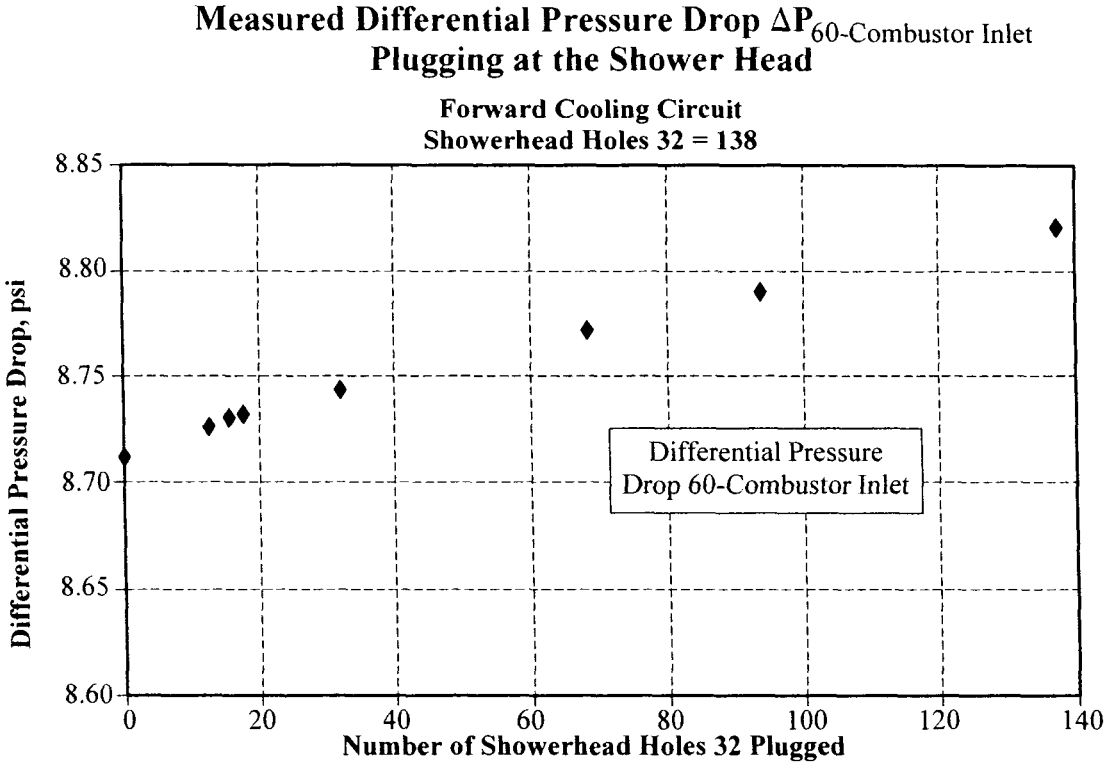
FIG. 6 is a chart depicting differential pressure drop verse number of holes plugged in a showerhead.
Figure 7:
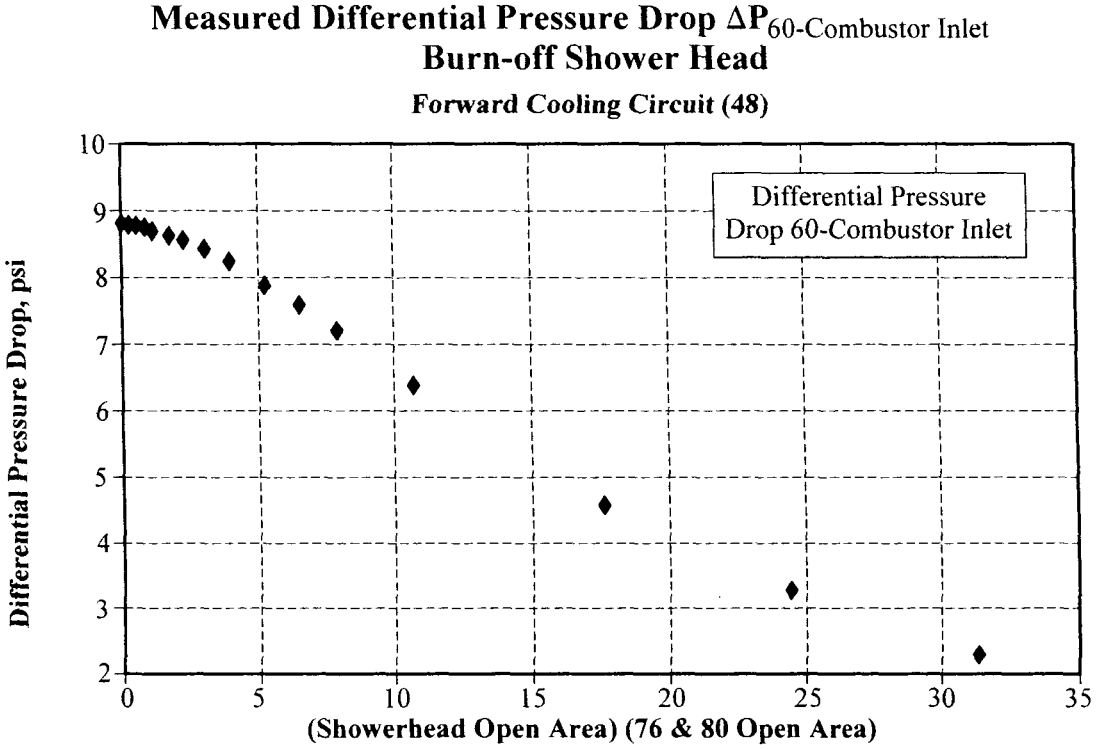
FIG. 7 is a chart depicting differential pressure drop verse amount of open area in the showerhead.

The detection system 10 may also be used to determine whether a portion or all of a showerhead 20 has burned off of the vane 24 or whether the showerhead 20 has plugged orifices 32. In particular, the detection system 10 may be used to identify decreases in differential pressure measured between a first pressure at an forward cooling cavity 48 and a second pressure outside of the outer wall 42 at the showerhead 20, as shown in FIGS. 6 and 7. The pressure outside the outer wall 42 at the showerhead 20 is not actually measured at this location. Rather, the pressure is measured from the combustor shell. Typically, the pressure at the combustor shell is approximately equal to the pressure found outside the outer wall 42 at the showerhead 20. A decrease in differential pressure may indicate that a portion of, or all of, a showerhead 20 has burned off, and an increase in differential pressure may indicate that at least some of the impingement orifices 32 are plugged.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine vane, comprising:

a generally elongated hollow vane formed from an outer wall, the vane having a leading edge, a trailing edge, a first end, a second end opposite the first end for sealing the turbine vane to a rotatable disc, and at least one cavity forming a cooling system in the vane;

at least one impingement insert in the at least one cavity forming an inner cooling cavity and an outer cooling cavity, whereby the at least one impingement insert includes at least one impingement orifice providing a gas pathway between the inner cooling cavity and the outer cooling cavity;

at least one first pressure sensor for measuring pressure in the inner cooling cavity; and at least one second pressure sensor for measuring pressure between the impingement insert and the outer wall of the turbine vane.

2. The turbine vane of claim 1, wherein the inner cooling cavity is divided into an inner forward cooling cavity and an inner aft cooling cavity, and the at least one first pressure sensor is positioned in one of the inner forward cooling cavity or the inner aft cooling cavity, and wherein the outer cooling cavity is divided into an outer forward cooling cavity and an outer aft cooling cavity, and the at least one second pressure sensor is positioned in one of the outer forward cooling cavity or the outer aft cooling cavity proximate to the inner cavity in which the at least one first pressure sensor is positioned.

3. The turbine vane of claim 2, wherein each of the inner forward cooling cavity and the inner aft cooling cavity includes a first pressure sensor, and each of the outer forward cooling cavity and the outer aft cooling cavity includes a second pressure sensor.

4. The turbine vane of claim 2, wherein the inner cooling cavity is further divided into an inner mid cooling cavity between the inner forward cooling cavity and the inner aft cooling cavity, and the at least one first pressure sensor is positioned in one of the inner forward cooling cavity, the inner aft cooling cavity, or the inner mid cooling cavity, and wherein the outer cooling cavity is further divided into an outer mid cooling cavity between the outer forward cooling cavity and the outer aft cooling cavity, and the at least one second pressure sensor is positioned in one of the outer forward cooling cavity, the outer aft cooling cavity, or the outer mid cooling cavity proximate to the inner cavity in which the at least one first pressure sensor is positioned.

5. The turbine vane of claim 4, wherein at least two of the inner forward cooling cavity, the inner aft cooling cavity, and the inner mid cooling cavity includes a first pressure sensor, and at least two of the outer forward cooling cavity, the outer aft cooling cavity, and the outer mid cooling cavity includes a second pressure sensor.

6. The turbine vane of claim 4, wherein each of the inner forward cooling cavity, the inner aft cooling cavity, and the inner mid cooling cavity includes a first pressure sensor, and each of the outer forward cooling cavity, the outer aft cooling cavity, and the outer mid cooling cavity includes a second pressure sensor.

7. An airfoil for use in a turbine engine, comprising:

a generally elongated hollow vane formed from an outer wall, the vane forming at least one cooling cavity and having a leading edge, a trailing edge, and a first end, a second end opposite the first end for sealing the vane to a rotatable disc, and at least one cavity forming a cooling system in the vane;

at least one impingement insert in at least one cavity forming an inner cooling cavity and an outer cooling cavity, whereby the at least one impingement insert includes at least one impingement orifice providing a gas pathway between the inner cooling cavity and the outer cooling cavity;

at least one first pressure sensor positioned in the inner cooling cavity for measuring pressure in the inner cooling cavity; and at least one second pressure sensor positioned in the outer cooling cavity for measuring pressure between the impingement insert and the outer wall of the airfoil.

8. The airfoil of claim 7, wherein the inner cooling cavity is divided into an inner forward cooling cavity and an inner aft cooling cavity, and the at least one first pressure sensor is positioned in one of the inner forward cooling cavity or the inner aft cooling cavity, and wherein the outer cooling cavity is divided into an outer forward cooling cavity and an outer aft cooling cavity, and the at least one second pressure sensor is positioned in one of the outer forward cooling cavity or the outer aft cooling cavity proximate to the inner cavity in which the at least one first pressure sensor is positioned.

9. The airfoil of claim 8, wherein each of the inner forward cooling cavity and the inner aft cooling cavity includes a first pressure sensor, and each of the outer forward cooling cavity and the outer aft cooling cavity includes a second pressure sensor.

10. The airfoil of claim 8, wherein the inner cooling cavity is further divided into an inner mid cooling cavity between the inner forward cooling cavity and the inner aft cooling cavity, and the at least one first pressure sensor is positioned in one of the inner forward cooling cavity, the inner aft cooling cavity, or the inner mid cooling cavity, and wherein the outer cooling cavity is further divided into an outer mid cooling cavity between the outer forward cooling cavity and the outer aft cooling cavity, and the at least one second pressure sensor is positioned in one of the outer forward cooling cavity, the outer aft cooling cavity, or the outer mid cooling cavity proximate to the inner cavity in which the at least one first pressure sensor is positioned.

11. The airfoil of claim 10, wherein at least two of the inner forward cooling cavity, the inner aft cooling cavity, and the inner mid cooling cavity includes a first pressure sensor, and at least two of the outer forward cooling cavity, the outer aft cooling cavity, and the outer mid cooling cavity includes a second pressure sensor.

12. The airfoil of claim 10, wherein each of the inner forward cooling cavity, the inner aft cooling cavity, and the inner mid cooling cavity includes a first pressure sensor, and each of the outer forward cooling cavity, the outer aft cooling cavity, and the outer mid cooling cavity includes a second pressure sensor.

13. A method of determining the presence of plugged impingement orifices in an airfoil, comprising:

measuring a first pressure in an inner cooling cavity of an airfoil formed by an impingement insert proximate to an outer wall of the airfoil to determine a first pressure measurement;

measuring a second pressure in an outer cooling cavity between the impingement insert and the outer wall of the airfoil to determine a second pressure measurement;

determining a differential pressure between the inner cooling cavity and the outer cooling cavity by comparing the first pressure measurement taken in the inner cooling cavity with the second pressure measurement taken in the outer cooling cavity; and comparing the differential pressure with known benchmark differential pressures to determine whether impingement orifices in the impingement insert are plugged.

14. The method of claim 13, further comprising concluding that impingement orifices are plugged when the differential pressure has changed by more than about 1 pound per square inch.

15. The method of claim 13, wherein measuring a first pressure in an inner cooling cavity of an airfoil comprises measuring an air pressure in an inner forward cooling cavity and wherein measuring a second pressure in an outer cooling cavity comprises measuring an air pressure in an outer forward cooling cavity.

16. The method of claim 15, further comprising concluding that orifices in the impingement insert are plugged if the differential pressure increases or concluding that the orifices in a suction side of the outer wall are plugged if the differential pressure decreases.

17. The method of claim 13, wherein measuring a first pressure in an inner cooling cavity of an airfoil comprises measuring an air pressure in an inner mid cooling cavity and wherein measuring a second pressure in an outer cooling cavity comprises measuring an air pressure in an outer mid cooling cavity.

18. The method of claim 17, further comprising concluding that orifices in the impingement insert are plugged if the differential pressure increases or concluding that the orifices in a pressure side of the outer wall are plugged if the differential pressure decreases.

19. The method of claim 13, wherein measuring a first pressure in an inner cooling cavity of an airfoil comprises measuring an air pressure in an inner aft cooling cavity and wherein measuring a second pressure in an outer cooling cavity comprises measuring an air pressure in an outer aft cooling cavity.

20. A method of determining burn off of a showerhead of an airfoil usable in a turbine engine, comprising:

measuring a first pressure in an inner forward cooling cavity of an airfoil proximate to a leading edge of the airfoil to determine a first pressure measurement;

measuring a second pressure in a combustor shell of the turbine engine to determine a second pressure measurement;

determining a differential pressure between the inner cooling cavity and a pressure outside the airfoil at the showerhead by comparing the first pressure measurement taken in the inner cooling cavity with the second pressure measurement taken in the said combustor shell; and comparing the differential pressure with known benchmark differential pressures to determine whether loss of the showerhead has occurred.

* * * * *